United States Patent [19]

Petersen et al.

[11] Patent Number: 4,634,481

[45] Date of Patent: Jan. 6, 1987

[54] METHOD OF MAKING FUEL PREPARING ELEMENTS FOR VAPOR BURNERS FED WITH LIQUID FUEL

[75] Inventors: Jørgen H. Petersen; Peter J. M. Clausen; Hilmar Ø. Rasmussen, all of Nordborg, Denmark

[73] Assignee: Danfoss A/S, Nordborg, Denmark

[21] Appl. No.: 659,785

[22] Filed: Oct. 11, 1984

Related U.S. Application Data

[62] Division of Ser. No. 550,310, Nov. 10, 1983, Pat. No. 4,497,625.

[30] Foreign Application Priority Data

Nov. 24, 1982 [DE] Fed. Rep. of Germany ..... 3243397

[51] Int. Cl.[4] ..... B32B 31/04; F23D 11/44

[52] U.S. Cl. ..... 156/89; 156/293; 156/294; 431/208

[58] Field of Search ..... 156/89, 293, 294; 431/208

[56] References Cited

U.S. PATENT DOCUMENTS 3,564,328 2/1971 Bagley et al. ..... 156/89
4,396,445 8/1983 Sasaki et al. ..... 156/89
4,487,644 12/1984 Gupta et al. ..... 156/89

FOREIGN PATENT DOCUMENTS 2707835 9/1977 Fed. Rep. of Germany ..... 156/89

*Primary Examiner*—Caleb Weston
*Attorney, Agent, or Firm*—Wayne B. Easton; Clayton R. Johnson

[57] ABSTRACT

The invention relates to a method of making for a vapor burner a tubular fuel preparing chamber which opens into a combustion chamber and is heatable to a relatively high temperature. The fuel preparing chamber is cooperable with an air supply system which supplies combustion air and is formed with ceramic tubes which are heatable to a glow temperature for effecting ignition and effecting a cleansing temperature wherein deposits on the wall of the chamber are burned to ash. The fuel preparing chamber includes a plurality of ceramic parts including first and second smaller and larger diameter tube parts with the first tube part being pushed into the inlet section of the second tube part. The chamber also includes a ceramic closure part at the outlet end of the second tube with which it has a close fit. The method involves assembling the ceramic parts and unifying them by said sintering.

8 Claims, 2 Drawing Figures

METHOD OF MAKING FUEL PREPARING ELEMENTS FOR VAPOR BURNERS FED WITH LIQUID FUEL

Figure 1:
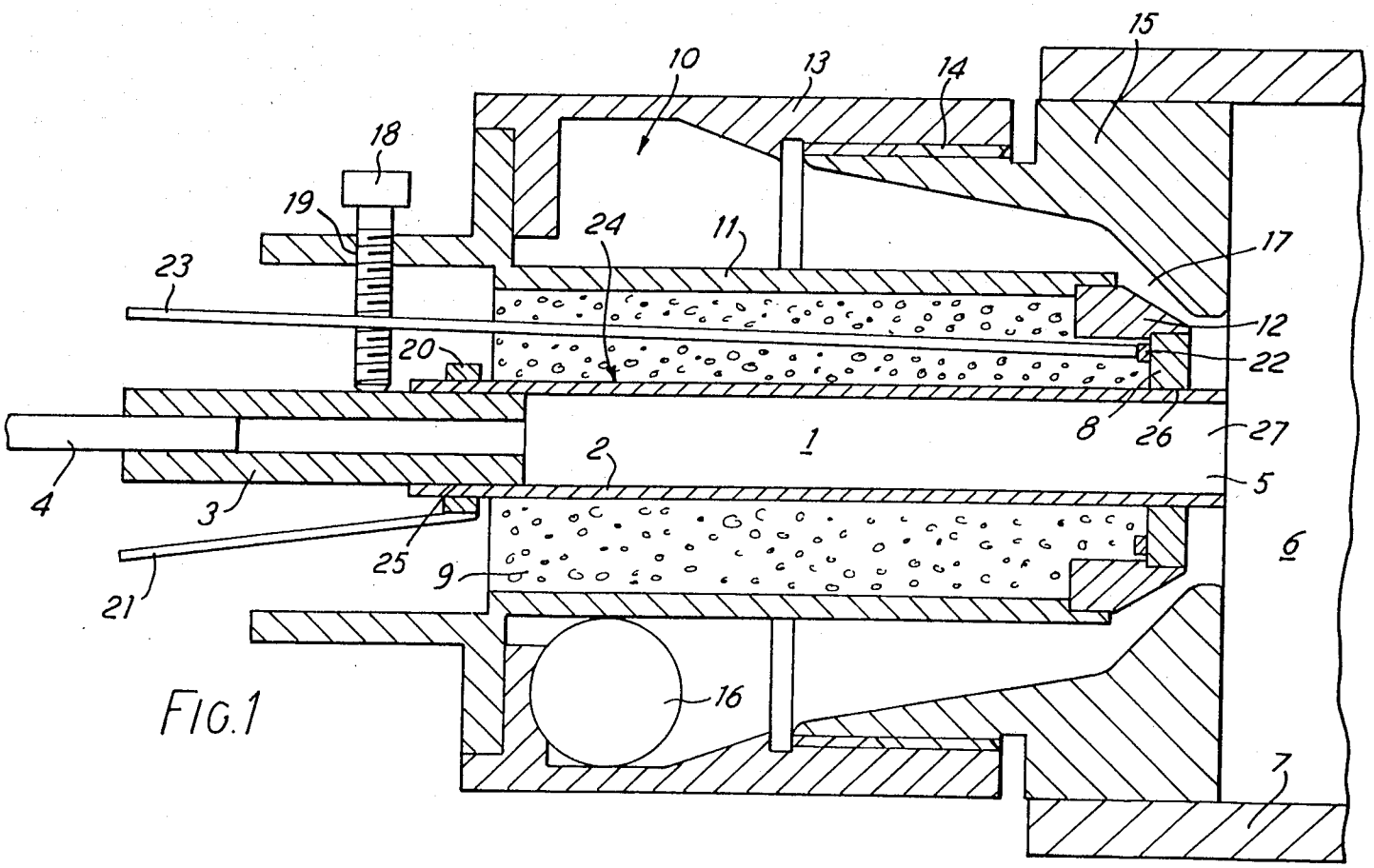

This application is a division of application Ser. No. 550,310 filed Nov. 10, 1983, now U.S. Pat. No. 4,497,625.

The invention relates to a highly heatable fuel preparing element, particularly for vapour burners fed with liquid fuel, comprising an electrically heatable fuel preparing chamber of which at least one outlet aperture opens into a combustion chamber, for co-operating with a passage system for supplying air of combustion to the combustion chamber, and to a method of making such a fuel preparing element.

A vapour burner of this kind is known (VDI Reports, No. 423, 1981, pages 175 to 180), having a heatable fuel preparing chamber in the form of a plurality of passages of small cross-section which are connected in parallel, accommodated in a hollow cylinder and surrounded on the outside by a heating coil. The outlet apertures at the outer periphery of the hollow cylinder are located at a position where air of combustion passes as a cylindrical jet. The production of such a vapour burner is extremely complicated.

The invention is based on the problems of providing a fuel preparing element of the aforementioned kind which is economical to produce and nevertheless operates effectively.

This problem is solved according to the invention in that a construction unit having the fuel preparing chamber is composed of a plurality of ceramic parts including a tube of larger diameter, a tube of smaller diameter pushed into the end section thereof, and at least one closure element at the other end section and that the parts of the constructional unit are sintered moulded or extruded parts with approximately equal coefficients of thermal expansion interconnected at their abutting areas in a heat-resistant manner.

With this construction, the constructional unit consists essentially of ceramic parts which withstand comparatively high temperature stresses. Consequently, the wall of the chamber can be brought to temperatures which are considerably higher than the lower limit of the gasifying temperature for liquid fuel. This is not only advantageous to gasify liquid fuel more rapidly. The ceramic tube can also be partially heated up to a glow temperature for effecting ignition or up to a cleansing temperature at which deposits at the wall of the chamber are burnt to ash. However, ceramic parts are difficult to work. For this reason, very simple moulded or extruded parts are employed. Since assembly with the aid of a screwthread or the like is not possible, the parts make surface contact with each other. With an adequate abutting area as readily obtainable in the case of cylindrical tubular faces, a gas-tight, heat-resistant and permanent connection is possible without difficulties as will hereinafter be explained. By using two tubes of different diameter one also obtains a very simple transition from the fuel supply tube of very small diameter to the fuel preparing chamber of larger diameter. With such a fuel preparing element, the flame can be fed with gaseous or gasified liquid fuel of elevated temperature. The fuel is exceptionally effectively prepared for the subsequent combustion. It is possible to achieve sootless and even stoichiometric operation as well as starting with a blue flame.

The ceramic parts can consist of the most varied materials, for example magnesium silicate, silicon nitride, cordierite etc. Silicon carbide is preferred, particularly if the silicon carbide parts are additionally saturated with silicon to bring about a hermetic seal.

Instead, or in addition, the silicon carbide parts may be provided with a cover of silicon oxynitride. This material is corrosion-resistant in oxidising as well as reducing atmospheres so that the life of the tubes is prolonged. In addition, this also brings about gas tightness. Finally, electric insulation is achieved.

In a preferred embodiment, at least one annular or sleeve-like insert is provided between the tubes of larger and smaller diameter. In this way, the fuel preparing chamber formed by the first-mentioned tube may have a compartively large diameter whereas the second-mentioned tube has dimensions adapted to the fuel supply tube.

The insert may have throttling passages which permit connection of the passage system to the fuel preparing chamber. In this way, part of the air of combustion can be introduced in the fuel preparing chamber. This secondary air ensures that oxygen will always be available in the gasifying chamber during starting so that a pilot flame is sure to be created. The secondary air also serves as a carrier gas to ensure efficient operation even at very small powers. During the cleansing phase to be described hereinafter, burning off of the deposits takes place more rapidly and the ash is reliably blown out.

The throttling passages should be dimensioned so that the secondary air passing therethrough is less than 1.9% of the air of combustion. Such small amounts, preferably even only 0.2 to 0.5% of the entire air of combustion, suffice to produce the described advantages. Conversely, the gasifying procedure is not detrimentally influenced.

Advantageously, two annular inserts are provided of which the passages are circumferentially offset. This produces a labyrinth seal which almost completely avoids the reverse escape of fuel particles.

The glass solder not only ensures a secure connection but also electric insulation between the ceramic parts. It is favourable if the tube of smaller diameter is of a ceramic material having a poorer heat conductivity than the other ceramic parts but substantially the same coefficient of thermal expansion. In this way, premature gasification of the liquid fuel is avoided. The tube may desirably also consist of electrically insulating material.

Further, the tube of smaller diameter may be connected to the tube of larger diameter or to the insert by means of a glass solder. A like connection is also possible between the tube of smaller diameter and a metal connecting tube which has substantially the same coefficient of thermal expansion and through which the fuel is supplied.

The closure element can be an end wall in the tube of larger diameter provided with outlet apertures. The outlet apertures give the jet of expelled fuel a particular shape. In addition, the end wall ensures that drops of fuel will stay in the gasifying chamber for a longer period and can therefore evaporate substantially completely. Further, it forms a protective zone for the initial ignition flame.

The closure element can also be a projecting ring which projects outwardly from the tube of larger diameter, has a projecting portion and is in the form of a glow head. Together with the gaseous fuel-air mixture initially leaving the fuel preparing chamber, the glow head forms an ignition flame which is sufficient for igniting the next following gasified fuel until a stable flame front has been established. The projecting part of the ring is heated by the flame so that the fuel preparing chamber is thereby itself heated indirectly and the electric energy for the heating appratus can be reduced.

The closure element may also be an external ring extending substantially up to the passing system. This ring can likewise receive radiations from the combustion chamber and additionally heat the fuel preparing chamber. It also forms a protective zone in which an initial ignition flame is protected from the entering air of combustion. The ring can further reduce the dissipation of heat so that a glow zone is produced at this position of the tube interior.

If the ceramic parts are of electrically conductive material and provided at intervals with terminals for the supply of current, they can themselves form part of the electric heating resistor. There will then be no thermal transition between the heating apparatus and the tube, whereby the fuel preparing element will be able to operate with less energy.

The electric terminals desirably consist of a material which can be soldered to silicon carbide with silicon and has substantially the same coefficient of thermal expansion. Such materials are, for example, titanium, molybdenum, tungsten, silicon carbide and the like. This produces simple soldering by mass production which can be performed at the same time as the other ceramic parts are assembled.

It is also favourable if the electric terminals consist of a metal which is made oxidation-proof by a treatment with silicon. The aforementioned metals are likewise suitable for this purpose.

Further, a heating apparatus is recommended with which the fuel preparing chamber can be heated to a cleansing temperature of 700° C. to 1400° C. and ceramic parts which are resistant to this cleansing temperature. In a cleansing phase during which no fuel is supplied, deposits can in this way be burnt to ash. The ash can then be blown out. It is in this case also favourable for ceramic parts to form the electric resistance because the deposits can then themselves be traversed by heating current and the burning to ash will be accelerated. Such automatic cleansing is of particular advantage if the fuel preparing chamber of the finished constructional unit is no longer accessible from the outside.

A method of making the fuel preparing element is characterised according to the invention in that the ceramic parts are assembled prior to sintering and then unified by sintering. Since the parts are juxtaposed along their abutting areas, this sintering step suffices for interconnecting the ceramic parts securely.

Another method is characterised according to the invention in that the silicon carbide parts are assembled after sintering and then unified by adding liquid silicon. The interstices at the abutting areas are so small that they become filled with silicon under capillary action and the desired heat-resistant joint is produced.

Figure 2:
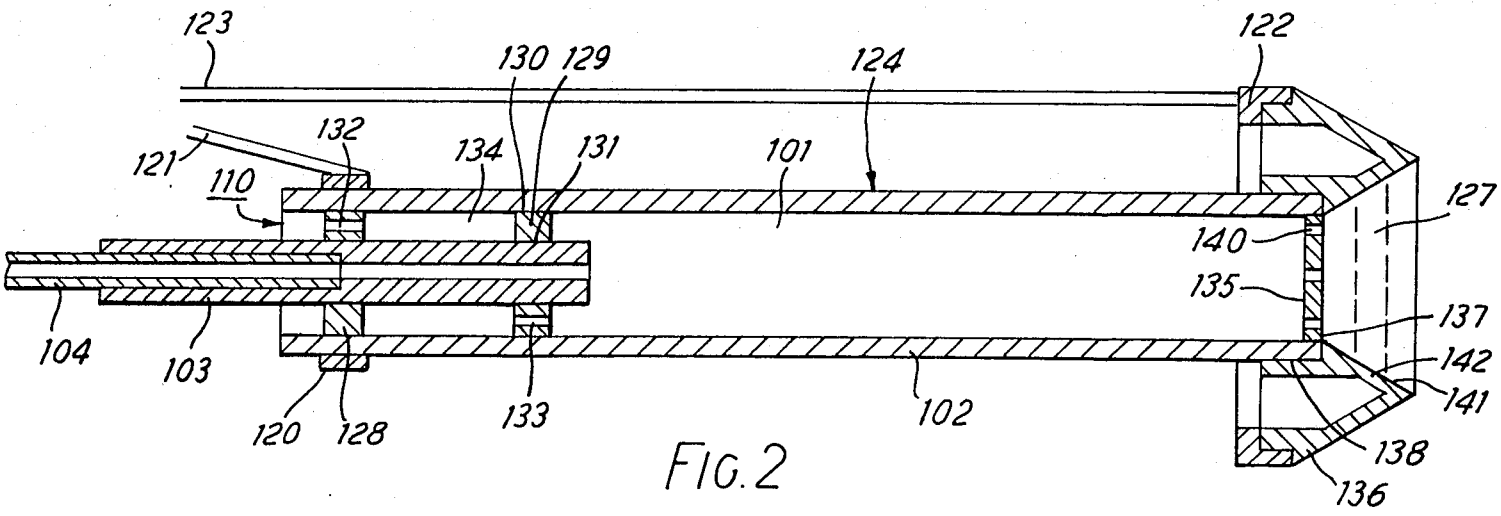

The invention will now be described in more detail with reference to preferred examples illustrated in the drawing, wherein:

FIG. 1 is a longitudinal section through a first embodiment of a fuel preparing element according to the invention, and FIG. 2 is a longitudinal section through the constructional unit of a second embodiment.

In FIG. 1, a fuel preparing chamber 1, particularly a gasifying chamber, is substantially bounded by a tube 2 of larger diameter. At the inlet side thereof, a tube 3 of smaller diameter is inserted. A supply conduit 4 for liquid fuel is, in turn, inserted in this tube, for example a standard capillary tube of stainless steel. The mouth 5 of tube 2 is directed towards a combustion chamber 6 which is bounded by a hollow cylindrical burner tube 7. At the outlet end of tube 2 is a closure element 8 in the form of an external ring. The tube 2 is surrounded by thermal insulation 9. A passage system 10 is bounded on the inside by a housing 11. The latter is connected to the closure element 8 by way of a guide ring 12 of thermally insulating ceramic material. On the outside, the passage system is bounded by a sleeve 13 and a burner head 15 connected thereto by way of a screwthread 14, so that air of combustion supplied tangentially through an inlet 16 can be fed as a rotating conical jet into the combustion chamber 6 by way of a conical annular gap 17. A screw 18 engaging through a screwthread 19 of housing 11 secures the position of the tube 3 of smaller diameter in conjunction with two other screws (not shown).

A connecting ring (annular electric terminal) 20 at the rear end of tube 2 is connected to a conduit 21 and a connecting ring (annular electric terminal) 22 near the external periphery of the closure element 8 is connected to a conduit 23. The two conduits 21 and 23 can be connected by way of a switching apparatus to a voltage source, whether this be the main voltage of a low voltage. The tube 2 and closure element 8 are of silicon carbide, i.e. an electrically conductive ceramic material. These parts therefore themselves form a heating apparatus 24. The tube 3 can also be of silicon carbide. Its external periphery is in contact with the inner circumferential area of tube 2 over a comparatively large abutment area 25. Similarly, the external periphery of the tube 2 is in contact with the internal circumferential area of the closure element 8 by way of a comparatively large abutment area 26. The electric terminal 20 and 21 can be soldered to the silicon carbide tube 2 and the closure element 8 respectively with silicon to be in electrically conductive relationship therewith.

Manufacture was carried out so that tubes 2 and 3 were extruded and the closure element 8 was moulded. The parts were then placed over each other and sintered together. In this way a construction unit was formed from the parts 2, 3 and 8 which could then be further treated as a whole.

Upon heating during operation, a glow zone 27 is produced which extends over the entire wall of the tube or at least the outlet zone thereof. When, on switching on the fuel preparing element, the first drop of oil has reached the fuel preparing chamber 1 and evaporated therein, a combustible mixture is formed together with the air contained in the tube 2 and is ignited by the glowing walls of the tube or by the glow zone 27 and forms an ignition flame which is pushed into the combustion chamber 6 by the following gaseous fuel. By reason of the gasification of the oil, the tube 2 is cooled on the inlet side. However, the supplied electric power is large enough to maintain the walls in the glow zone 27 in a glowing condition. The following gaseous fuel is mixed with the air of combustion entering through the passage system 10. The combustible mixture thus formed is ignited by the ignition flame. The main flame can also be assisted by the glow zone 27. One therefore obtains a gentle start from the very first drop of fuel until a stable flame front is produced in the combustion chamber 6. The flame is a transparent blue even during starting. There are practically no soot deposits.

By heating without the supply of fuel, the tube 2 can be heated to a cleansing temperature of between 700° C. and 1400° C. at which all deposits at the wall of the tube are burnt to ash. During the next switching-on phase, this ash is blown by the developed gaseous fuel and the supplied secondary air into the combustion chamber 6.

In the FIG. 2 embodiment, parts corresponding to those in FIG. 1 have reference numerals increased by 100. In this case there are two annular inserts 128 and 129 between the tube 102 of large diameter and the tube 103 of smaller diameter. Cylindrical abutment faces 130 and 131 are again produced on the outside and inside. The inserts 128 and 129 each have throttling passages 132 and 133 which are offset from each other. An intermediate space 134 is left between the inserts. Secondary air of combustion can be led through these passages out of the passage system 110 into the fuel preparing chamber 101 but the amount should be very small, for example between 0.2 and 0.5% of the entire air of combustion.

At the other end of tube 102 there is a first closure element 135 in the form of an inserted end wall and a second closure element 136 in the form of a projecting ring that is placed on. In both cases, there are again cylindrical abutment faces 137 and 138. The closure element 135 has outlet apertures 140 by which the jet of leaving gaseous fuel can receive a particular shape. The closure element 136 has an internal cone 141 which is partially bounded by a thinner wall section 142 so that a glow zone 127 is produced at this position when heating takes place.

In this case, the tube 102 and closure element 136 are likewise of silicon carbide so that the heating current can flow directly through these parts.

The constructional unit comprises the parts 102, 103, 128, 129, 135 and 136. The tubes 102 and 103 are extruded members and the other elements are moulded parts. They are first sintered and then assembled. The constructional unit is thereupon infiltrated by or saturated with liquid silicon. This occurs at a very high temperature of, for example, 1800° C. The parts of the constructional unit are thereafter rigidly interconnected.

In this FIG. 2 construction, there is again a gentle start at the glow zone with a blue flame and practically no soot formation. The automatic cleansing is particularly valuable because the interior of tube 102 is no longer accessible.

We claim:

1. A method of making a fuel preparing unit for a vapour burner which unit comprises a plurality of ceramic parts including a smaller diameter first tube part having a first end portion and a second end portion, a larger diameter second tube part having a first end portion and a second end portion with the first tube part second end portion being pushed into the second tube part first end portion, and an annular closure element projecting radially outwardly of the second tube part second end portion, a first annular electric terminal on the second tube part first end portion and a second annular electric terminal on the closure element, said method comprising the steps of assemblying said tube parts and closure element in the above relationship, sintering said assemblied tube parts and closure element to unify them and soldering the first and second electric terminals to the second tube first portion and the closure element respectively in electrically conductive relationship, the second tube part and closure element being of an electrically conductive material.

2. The method of claim 1 further characterized in that the smaller diameter tube part is of a ceramic material that has a poorer thermal conductivity than the other tube part but with substantially the same coefficient of thermal expansion.

3. The method of claim 1 wherein the electric terminals are made of a metal having substantially the same coefficient of thermal expansion as the second tube part and the closure element.

4. The method of claim 3 wherein the electric terminals are treated with silicon to make them oxidation proof.

5. The method of claim 1 wherein the smaller diameter tube part, the larger diameter tube part and closure element are made of silicon carbide.

6. The method of claim 5 wherein the smaller diameter tube part, the larger diameter tube part and closure element are provided with a cover of silicon oxynitride.

7. The method of claim 5 wherein the electric terminals are soldered to the larger diameter tube part with silicon.

8. A method of making a fuel preparing unit for a vapour burner which unit comprises a plurality of ceramic parts including a smaller diameter first tube part having a first end portion and a second end portion, a larger diameter second tube part having a first end portion and a second end portion with the first tube part second end portion being pushed into the second tube part first end portion, and an annular closure element projecting radially outwardly of the second tube part second end portion, a first annular electric terminal on the second tube part first end portion and a second annular electric terminal on the closure element, said method comprising the stpes of sintering the tube parts, closure element and electric terminals, assembling the sintered tube parts, closure element and electric terminals in the above mentioned relationship, and thence unifying the tube parts, closure element and electric terminals by applying liquid silicon, the tubular parts, closure element and electric terminals being made of a silicon carbon material.

* * * * *